US007921777B2

(12) United States Patent
Dahlberg

(10) Patent No.: US 7,921,777 B2
(45) Date of Patent: Apr. 12, 2011

(54) METHOD AND ARRANGEMENT FOR PRODUCING PROPELLANT FOR CHARGES WITH HIGH CHARGE DENSITY AND HIGH PROGRESSIVITY

(75) Inventor: Johan Dahlberg, Örebro (SE)

(73) Assignee: Eurenco Bofors AB, Karlskoga (SE)

( * ) Notice: Subject to any disclaimer, the term of this patent is extended or adjusted under 35 U.S.C. 154(b) by 672 days.

(21) Appl. No.: 10/582,114

(22) PCT Filed: Dec. 8, 2004

(86) PCT No.: PCT/SE2004/001821
§ 371 (c)(1),
(2), (4) Date: Aug. 7, 2008

(87) PCT Pub. No.: WO2005/057124
PCT Pub. Date: Jun. 23, 2005

(65) Prior Publication Data

US 2008/0282926 A1 Nov. 20, 2008

(30) Foreign Application Priority Data

Dec. 9, 2003 (SE) ..... 0303301

(51) Int. Cl.
*D03D 23/00* (2006.01)
*C06B 21/00* (2006.01)

(52) U.S. Cl. ..... 102/283; 264/3.1; 149/109.6

(58) Field of Classification Search ..... 102/283, 102/285, 286, 287, 289, 290, 291, 292; 149/109.6; 264/3.1; 86/1.1
See application file for complete search history.

(56) References Cited

U.S. PATENT DOCUMENTS 677,527 A 7/1901 Maxim
677,528 A 7/1901 Maxim
(Continued)

FOREIGN PATENT DOCUMENTS

SE 7728 11/1896
(Continued)

OTHER PUBLICATIONS

International Search Report No. PCT/SE2004/001821, dated Jan. 3, 2005, 2 pgs.

*Primary Examiner* — James S Bergin
(74) *Attorney, Agent, or Firm* — Connolly Bove Lodge & Hutz LLP

(57) ABSTRACT

The present invention relates to a method and an arrangement for the production of radially perforated, cylindrical propellant tubes (1, 23, 31). The invention is based on the underlying idea that the respective propellant tube (1, 23, 31) must be fixed and centred between its own open ends and thereafter to be perforated in stages in a large number of consecutive perforation operations by means of one or more pins (13) capable of displacement in a pin die (10) relative to the propellant tube towards and at least through the major proportion of the cylindrical wall of the propellant tube. Also included in the invention is the requirement for the displacement, between each perforation operation, of the propellant tube and the pin die (10) used for the preparation operation in such a way relative to one another that the propellant tube, after a complete perforation operation, shall be covered in its entirely by perforations (32, 33, 35, 36), which lie at a predetermined e-dimension distance from one another.

15 Claims, 2 Drawing Sheets

U.S. PATENT DOCUMENTS

| | | | | | |
|---|---|---|---|---|---|
| 694,295 | A | | 2/1902 | Maxim | |
| 766,455 | A | * | 8/1904 | Maxim | 102/283 |
| 3,099,963 | A | * | 8/1963 | Dobrin et al. | 102/290 |
| 3,116,692 | A | * | 1/1964 | Rumbel et al. | 102/289 |
| 4,161,873 | A | | 7/1979 | Mabery | |
| 4,581,998 | A | * | 4/1986 | Horst et al. | 102/289 |
| 4,989,482 | A | | 2/1991 | Mason | |
| 5,063,851 | A | * | 11/1991 | Moscrip | 102/433 |
| 5,251,549 | A | * | 10/1993 | Boisseau et al. | 102/289 |
| 5,349,892 | A | * | 9/1994 | Taylor et al. | 86/21 |
| 5,460,026 | A | | 10/1995 | Schafer | |
| 5,642,640 | A | | 7/1997 | Insalaco et al. | |
| 5,666,840 | A | | 9/1997 | Shah et al. | |
| 5,673,580 | A | | 10/1997 | Ohno | |
| 5,737,952 | A | | 4/1998 | Baumann et al. | |
| 5,974,846 | A | | 11/1999 | Ash | |
| 6,071,444 | A | * | 6/2000 | Worrell et al. | 264/3.1 |
| 6,098,441 | A | | 8/2000 | Hada et al. | |
| 6,212,982 | B1 | | 4/2001 | Augustin et al. | |
| 7,507,308 | B2 | * | 3/2009 | Dahlberg et al. | 149/109.6 |
| 2008/0047453 | A1 | * | 2/2008 | Dahlberg | 102/290 |
| 2009/0148549 | A1 | * | 6/2009 | Dahlberg et al. | 425/290 |

FOREIGN PATENT DOCUMENTS

| | | |
|---|---|---|
| WO | WO-02083602 | 10/2002 |

* cited by examiner

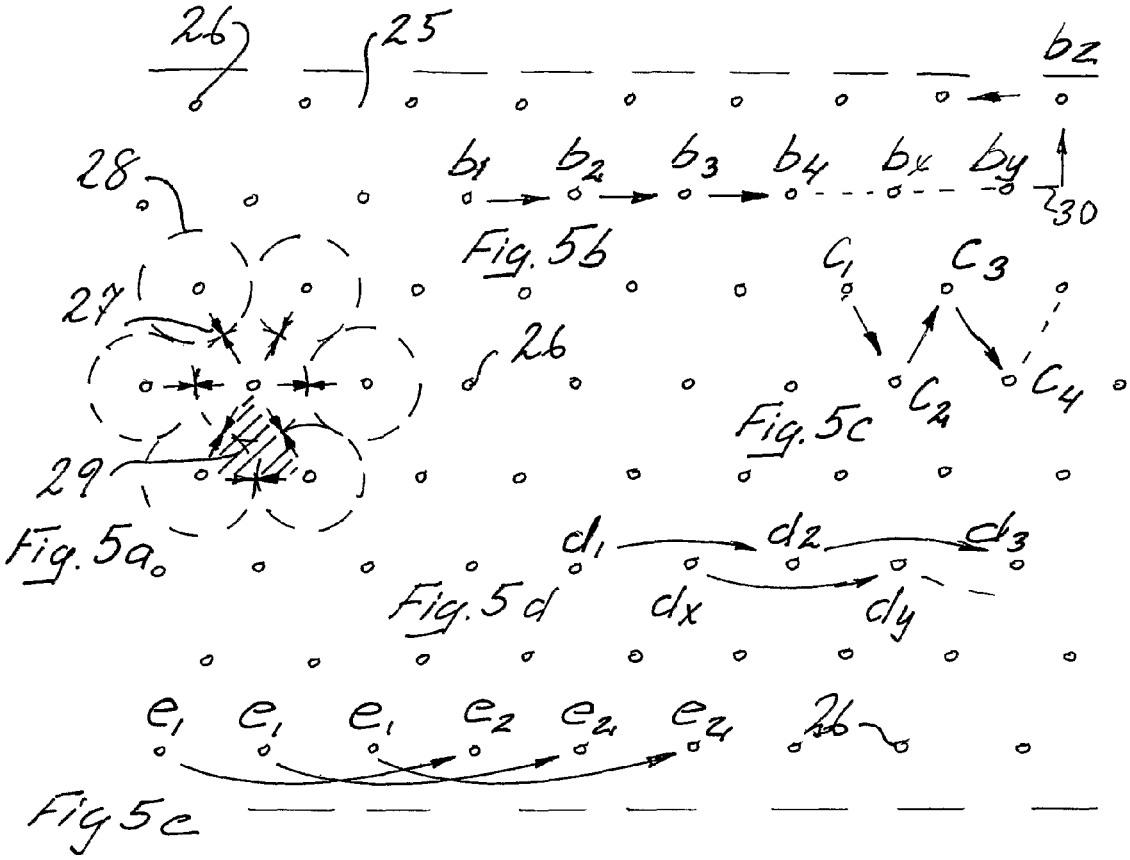
26
25
bz
28
b1 b2 b3 b4 bx by
30
Fig. 5b
c1 c3
27
26
c2 c4
Fig. 5c
29
Fig. 5a
d1 d2 d3
Fig. 5d
dx dy
e1 e1 e1 e2 e2 e2 26
Fig 5e
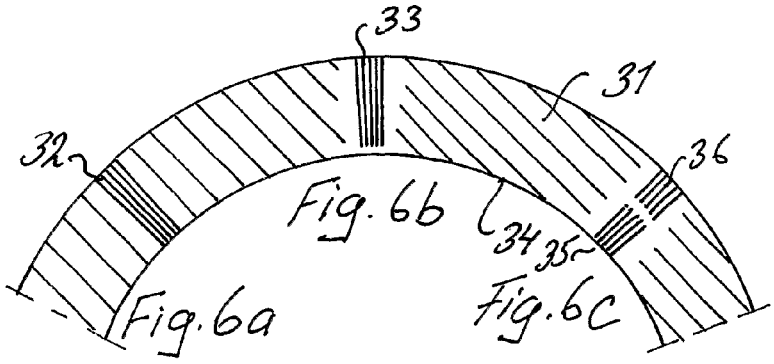
33
31
32
36
Fig. 6b
34 35
Fig. 6a
Fig. 6c

METHOD AND ARRANGEMENT FOR PRODUCING PROPELLANT FOR CHARGES WITH HIGH CHARGE DENSITY AND HIGH PROGRESSIVITY

This application is a National Phase application of PCT/SE2004/001821, filed Dec. 8, 2004, which claims priority to Swedish patent appl. no. 0303301-6, filed Dec. 9, 2003.

TECHNICAL FIELD

The present invention relates to a method and an arrangement for producing radially perforated propellant tubes, which, when combined with one another in the manner described in our own Swedish patent application SE0303300-8 entitled "Progressive propellant charge with high charge density" filed at the same time as this application, provide propellant charges with extremely high charge density and very high progressivity adapted for barrel weapons, and in particular direct-firing barrel weapons such as tank cannons.

PRESENTATION OF THE PROBLEM AND BACKGROUND TO THE INVENTION

In conjunction with firing a propellant gas-driven projectile from a barrel that is closed at the rear in the direction of firing, a certain initial propellant gas pressure is first required behind the projectile in order to cause it to begin to accelerate along the barrel. Given that the part of the volume of the barrel situated behind the projectile increases successively as the projectile moves along the barrel, increased quantities of propellant gas will be required successively during firing to a corresponding degree in order continuously to increase the velocity of the projectile for as long as it remains in the barrel. Accordingly, the ideal propellant charge would, as it burns, successively provide increasingly large quantities of propellant gas per unit of time, although, in conjunction with this, it must not at any time give a propellant gas pressure inside the barrel in question which exceeds the maximum permissible barrel pressure Pmax applicable to the barrel and to parts of the mechanism associated therewith. The entire propellant charge should also be fully expended when the projectile leaves the barrel, as the trajectory of the projectile can otherwise be disrupted by the exiting propellant gases, at the same time as which the propellant charge cannot be fully utilized for the intended purpose.

A propellant which, as it burns under constant pressure, gives off a quantity of propellant gas per unit of time, which increases successively with the combustion time, is said to be progressive. The propellant may, for example, have acquired its progressive characteristics as a consequence of a specific geometrical form which presents an increasingly large combustion area the longer combustion of the same continues, although it may also have acquired its progressive characteristics as a consequence of a chemical or physical surface treatment of parts of the free surfaces of the individual grains of propellant or pieces of propellant contained in the propellant that are accessible for ignition. Propellant charges with at least limited progressive characteristics can thus be produced from granular propellant simply by the choice of an appropriate geometrical form for the grains of propellant contained in the charge.

Granular, single-perforated or multi-perforated propellants provided with transcurrent combustion channels or perforations in the longitudinal direction of the propellant grains are ignited and burn both internally in their respective perforations or combustion channels, and from the outside of the propellant grains. This means that there will be a successive increase in the inner combustion areas of the channels, and consequently in the generation of propellant gas therefrom, although at the same time the outer combustion areas of the propellant grains will be reduced as the propellant is also burnt from the outsides of the propellant grains, which gives a reduction in the generation of propellant gas from these surfaces. In order for a granular perforated propellant of this kind to be truly geometrically progressive, there is accordingly a requirement for the successive increase in the propellant channels' own combustion areas actually to exceed the simultaneous successive reduction in the outer combustion areas of the propellant grains. An externally untreated single-perforation propellant with the outer form of a true cylinder normally burns at a constant rate for this reason, whereas a 19-perforation propellant with the external form of a round bar, and similarly untreated, will normally burn progressively.

Also previously disclosed for some time is the ability to increase the progressivity of a granular multi-perforation propellant, and to make a single-perforation propellant progressive, by the inhibition or chemical surface treatment of the outer surfaces of the propellant grains. In conjunction with inhibition, the outer combustion areas of the propellant grains, as well as their end surfaces, are coated with a less readily-combustible substance which delays the propagation of the ignition of the propellant along its surfaces, and in the case of surface treatment the same surfaces are treated with an appropriate chemical substance, such as a solvent or equivalent, which causes the propellant to burn more slowly along these surfaces and for a certain distance into the propellant. In accordance with a third variant, the propellant can be made progressive by coating its outer surfaces with a layer of a propellant which requires to be burnt away first before propagation of the ignition of the outer surfaces of the grains or pieces of the actual propellant charge can take place.

For a number of years, intensive work has been carried out into increasing the range of fire of older artillery pieces by providing them with more up-to-date ammunition. An initial limiting factor has been the stipulation that the maximum permissible barrel pressure Pmax must never be exceeded. A second previously limiting factor has been that an increased range of fire tends to require an increased charge weight in a charge space that is already fully utilized as a rule in the case of the originally existing charges of loose granular perforated propellant. A third limitation is also that a high charge density requires a progressivity which increases in parallel.

In the case of loose granular material, however, the combined empty volume between the grains is proportionately large. One possibility would thus be to increase the density of the charge. The greatest quantity of propellant, and thus the greatest charge density and the greatest charge weight, that can be achieved in a fixed volume is a solid body with a geometry that is adapted entirely in accordance with the available volume. However, an entirely solid body of propellant does not offer a general solution to the problem of increasing the range of fire of existing artillery pieces. The solid body of propellant will burn for too long, in fact, and will produce a propellant gas pressure that is too low to be utilized effectively to fire projectiles.

From a theoretical point of view, it is possible to conceive of producing a multi-perforated block propellant which burns in a similar fashion to a larger quantity of granular multi-perforated propellant, i.e. at least initially only via the combustion channels or perforation holes contained therein. It is not so simple in practice, however. The theoretically conceived multi-perforated block propellant must accordingly be provided in its entirety with a very large number of combustion channels running in parallel, all of which are located at a distance from all adjacent combustion channels equivalent to twice the distance for which the propellant is able to burn during the period available until immediately before the time at which the projectile is considered to have exited from the barrel from which it has been fired. The distance between two combustion channels in a specific propellant is referred to as its e-dimension, and the e-dimension for the propellant that is contained in a specific charge should correspond to the distance for which the propellant is able to burn, during the firing of a specific projectile from the time of ignition until the time at which the projectile exits from the barrel, with complete combustion during the dynamic pressure sequence in the particular artillery piece for which the propellant is intended. In order for a multi-perforated propellant to be capable of being utilized optimally, it is necessary, therefore, for two adjacent perforations or combustion channels to be separated from one another by the distance of the e-dimension in question in each individual case. In order to ensure the best possible firing result, the combustion time of the propellant in barrel weapons must be neither too short, as the projectile fired in this way with an insufficiently long combustion time will have a muzzle velocity, and thus a range of fire that is too low, nor too long, as unburned propellant will then be expelled from the barrel without contributing to the acceleration of the projectile.

In the case of both the well-inhibited, granular perforated propellant and the multi-perforated block propellant, the propellant ignites in all of its combustion channels, and these burn radially outwards towards one another from the respective combustion channel. Thus, if the right e-dimension has been selected, the combustion surfaces from the different combustion channels will meet immediately before the passage of the projectile through the muzzle. In order to ensure that the combustion of the propellant from the outer parts of the propellant grains does not interfere with the geometrical progressivity, all of the outer propellant surfaces must ideally be inhibited, surface treated or surface coated for this purpose, including the propellant surfaces alongside the perforations.

Presented in on our Swedish patent application SE0303300-8 referred to in the introduction is a new type of propellant charge for barrel weapons constructed from one, two or more propellant tubes perforated radially at selected e-dimension distances and arranged inside one another and/or after one another, which tubes burn with a certain overlap that has been achieved by the one or more tubes that must come later in the combustion chain having been inhibited, surface treated or surface coated along all their outer surfaces in order to delay the propagation of ignition along these surfaces.

The starting material for this charge is thus multi-perforated propellant tubes which have been inhibited, surface treated or surface coated, as required, in order subsequently to be arranged concentrically inside one another and/or after one another.

One difficulty encountered in the production of this type of charge is how to make the radially perforated propellant tubes. In order to be capable of being used and giving the desired result, however, the e-dimension at the perforations in the propellant tubes must lie between 0.5 mm and 10 mm, but preferably between 1 mm and 4 mm. In order to give the desired result in the charges in question, the propellant tubes must also be perforated radially. The requirements for the perforation to be executed in a uniform fashion must be set very high, moreover.

PRIOR ART

The theoretical principles behind a propellant charge consisting of a plurality of tubular layers of multi-perforated propellant are not entirely novel, given that H. Maxim was already awarded U.S. Pat. No. 677,527 in respect of a charge of this kind in 1901, although on the one hand he proposed flat perforated sheets of propellant which he rolled, and on the other hand it is nowhere apparent in the Patent that he would have had any notion at all of how close together the perforations really must be located in order for a charge of this kind to function, i.e., with the technology of the time, he would not have had any opportunity to determine the rate at which a propellant actually burns.

The present invention relates to a plurality of methods and arrangements for producing perforated propellant tubes with sufficiently closely-spaced radial perforation, i.e. with an e-dimension of between 0.5 mm and 10 mm, but preferably between 1 mm and 4 mm, to enable their use in the actual type of charge proposed by us here.

In accordance with the present invention, we have now solved the problem of executing the necessary closely-spaced perforation by dividing up the perforation operation into a very large number of perforation stages, each and every one of which gives rise to a single perforation or a small number of perforations. The production of perforated propellant tubes of the type intended here in accordance with this method will accordingly require a not insignificant time, although at the same time our invention offers the possibility of executing the entire perforation process in fully automatic machines which do not require any actual operatives other than for reprogramming and, if necessary, when replacing propellant tubes.

The present invention can thus be defined as a method for producing radially perforated, cylindrical propellant tubes based on the underlying idea that the respective propellant tube shall be fixed and centred between its own open ends and thereafter perforated in stages in a large number of consecutive perforation operations by means of a movable pin die guided radially relative to the propellant tube towards and at least through the major proportion of the cylindrical wall of the propellant tube. This pin die must then be returned after every perforation to its starting position before the perforation, in which position the pin die and the propellant tube are subjected to relative displacement axially in the longitudinal direction of the propellant tube, or by rotation of the propellant tube, or by a combination of both, and are thereby brought into an adjustment position such that the pin die perforates new, unprocessed propellant material in the next perforation stage. The relative displacement of the pin die and the propellant tube between two perforation stages shall, at the same time, be controlled in such a way that all perforations after the perforation operation is complete lie at a distance from adjacent perforation corresponding to the desired e-dimension for the intended application of the propellant tube.

A large number of different variants of the stepped displacement of the needle die are possible, due in part to whether use is made of a single pin or a plurality of pins arranged in a predetermined pattern. The main principle is that, once perforation is complete, all perforations shall be radial and shall be situated at the desired e-dimension from one another.

The pin die can, for example, be displaced between the perforation stages in a linear fashion along the entire length of the propellant tube until such time as the whole of that length is covered by perforations, after which the propellant tube is rotated about its longitudinal axis through the angle that corresponds to the desired e-dimension, so that new, unprocessed material faces towards the pin die, after which the previously unprocessed part of the propellant tube is perforated in a corresponding fashion followed by a further rotation of the propellant tube until such time as it has been perforated in its entirety with the desired e-dimension between the perforations. It may be justifiable to point out in this context that, since it is the geometrical proportion of the equilateral triangle that determines the distance between adjacent rows of perforations, both a certain rotation of the propellant tube corresponding to the height of the equilateral triangle having the e-dimension as its length of side and a longitudinal displacement between the rows of perforations corresponding to half the e-dimension are required for the axial rectilinear perforation of a propellant tube row by row (see also FIG. 5*a*).

Another variant is based on the fact that the internal displacement movement between the propellant tube and the pin die between the perforation stages is distributed as a rotation of the propellant tube and a longitudinal feed of the pin die, whereby both of these movements are selected so that the perforation of the propellant tube will run in a spiral path around it from its one end to its other end, after which a new spiral path at an e-dimension distance from the first begins, until the whole of the propellant tube has been covered by perforations at an e-dimension distance from one another.

In accordance with a third variant, the mutual relative feeding of the pin die and the propellant tube is executed by a controlled rotation of the propellant tube combined with a reciprocating stepped feed between each perforation until one row has been covered by perforations, after which the pin die is fed for the number of e-dimensions for which it contains pins for the execution of the next row of perforations.

In the design of the interacting pattern of movement of the pin die and the propellant tube, it is necessary to bear in mind at all times that three adjacent perforations must always form the corner points of an equilateral triangle, the respective sides of which are all equal to one e-dimension.

As already mentioned, it is also possible in conjunction with perforation of the propellant tube to utilize a pin die with a plurality of perforation pins arranged one after the other in a row at an e-dimension distance from one another and aligned in a row after one another in the longitudinal direction of the propellant tube. In this case, however, the longitudinal feed of the pin die in the longitudinal direction of the propellant tube between each perforation stage must be equivalent to the number of e-dimensions covered by the pins of the die (FIG. 5E).

In the case of pin dies comprising both single pins and a plurality of pins, different types of reciprocal feeds, zig-zag feeds and feed charts which provide for concentrations of a basic perforation can occur, of course. The latter variant may offer certain advantages, since what is involved is the perforation of a propellant which is readily deformed if it is perforated directly by perforating pins that are working too close together (see FIG. 5D).

The difficulties that arise in conjunction with the production of a fully automatic machine in accordance with the present invention are associated to a large part with the precision engineering that must be included in the same. It is far from easy simply to produce a pin die containing a limited number of pins arranged in line with one another at a desired e-dimension distance, i.e. in certain cases a distance of less than 1 mm. As far as the subsequent limited feed and rotation stages that must be included in the system are concerned, the need may arise for both microcomputer control and abutments between precision-ground abutment heels and fixed gauge blocks.

The characterizing arrangement for the invention includes in the first place a fixing device for the securing and axial alignment of propellant tubes. For example, this device may consist of conical end guides capable of displacement relative to one another and capable of being introduced into the open ends of the respective propellant tube for centring the propellant tube and for clamping the propellant tube. In the second place, the arrangement shall include at least one pin die capable of being displaced against the outer surface of the propellant tube in the fixed position and through the propellant tube comprising one or more pins arranged in the longitudinal direction of the propellant tube at the desired e-dimension distance. This pin die and the propellant tube shall also be connected together in such a way as to permit movement, so that, after each and every one of the perforation stages executed by the pin die and after the pin die has been returned to the starting position, they can be displaced relative to one another for a certain distance equivalent to the number of e-dimensions represented by the row of pins, so that new propellant material is exposed under the pin die (FIG. 5*e*).

It is also possible, of course, to manufacture an arrangement equipped with a plurality of pin dies which penetrate the propellant tube simultaneously from a number of mutually opposing directions, which thus balance one another, although even if a multi-pin die machine of this kind, for example having three pin dies arranged at an angle of 120°, reduces the time necessary for a complete perforation, the arrangement will at the same time become so much more complicated.

For large charges, there may be a requirement for perforated propellant tubes of up to or in excess of one metre in length, and it may then be appropriate to support the propellant tubes on support rollers or an internal roller support or abutment, although this must not interfere with the penetration of the propellant tube by the pins. It is not always necessary, moreover, to cause the perforation pins to pass all the way through the wall of the propellant tubes. In certain cases, for example, it may be appropriate to leave an inner propellant wall unperforated to a depth of one e-dimension or equivalent.

DESCRIPTION OF THE DRAWINGS

The method and arrangement in accordance with the invention is defined in the following Patent Claims, and it need only be described here in slightly more detail in conjunction with the following Figures. Of these.

FIGS. 5*a-e* are different principles for stepped perforation; and

FIGS. 6*a-c* are part-sections through a perforated propellant tube.

DETAILED DESCRIPTION OF THE PREFERRED EMBODIMENT

Figure 1:
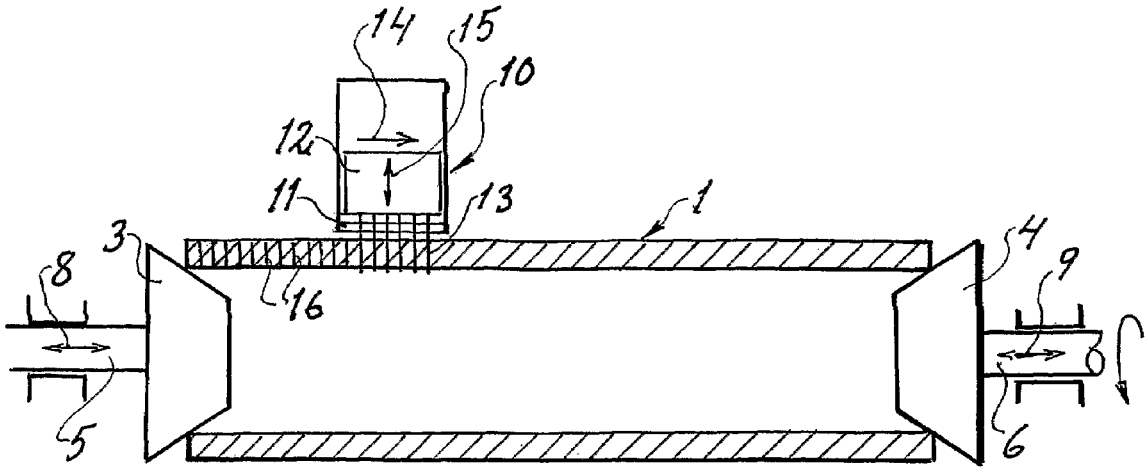
FIG. 1 shows a longitudinal section through an arrangement in principle for the perforation of propellant tubes in the method that is characteristic of the invention.

FIG. 1 shows a longitudinal section through a propellant tube 1 that is clamped and centred between two conical ends 3 and 4. Each of these is in turn supported in such a way as to permit rotation on its own axles 5 and 6 arranged in the longitudinal direction of the centred propellant tube 1. As can be appreciated from the Figure, the axles 5, 6 with the associated ends 3, 4 are capable of axial displacement in the direction of the arrows 8, 9. The reason for this is to permit clamping of the propellant tube 1. Also present is a pin die 10 that is capable of displacement in the longitudinal direction of the propellant tube. This comprises a pin guide 11, a pin holder 12 capable of displacement to and from the propellant tube and six perforation pins with the common designation 13 contained in the latter and guided by the pin guide 11. The pin die 10 in its entirety is capable of displacement along the propellant tube 1 in the direction of the arrow 14. At the same time, the pin holder 12 is capable of displacement to and from the propellant tube 1 in the direction of the arrow 15. Also depicted in the Figure are twelve previously executed perforations with the common designation 16. These perforations are the result of two previously executed perforation operations. Because the pins in the pin holder 12 are situated at the desired e-dimension distance, this arrangement gives six perforations per perforation operation. As soon as the pins 13 have perforated the propellant tube, they are returned with the upward movement of the pin holder 12 to their starting position in the pin die 10, after which this is advanced by one step equivalent to six e-dimensions, and a new perforation operation is executed. When the pin die 10 reaches the end of the propellant tube 1, the propellant tube is caused to rotate through the angle, and the pin die is caused to be displaced longitudinally for the distance, which, when perforating additional axial rows of perforations, give perforations at the desired e-dimension distance from one another. The entire operation is then repeated until the entire propellant tube has been perforated.

Figure 2:
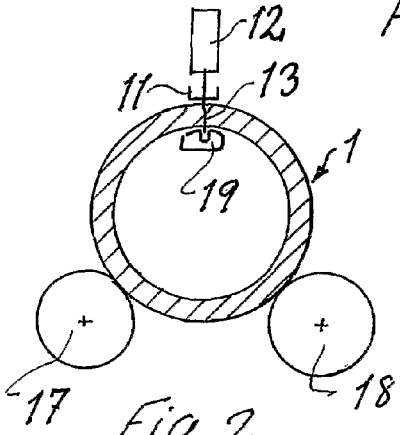
FIG. 2 shows a cross section through the arrangement in accordance with FIG. 1.

Illustrated in FIG. 2 is a variant that is suitable for long and more thin-walled propellant tubes, which are supported by rollers 17 and 18 and where the propellant tube has also been provided with an internal abutment 19. The internal abutment 19 appropriately comprises a tube which is so arranged as to hold the propellant tube horizontally, the resulting advantage of which is that the pins do not need to pass through the propellant tube.

Figure 3:
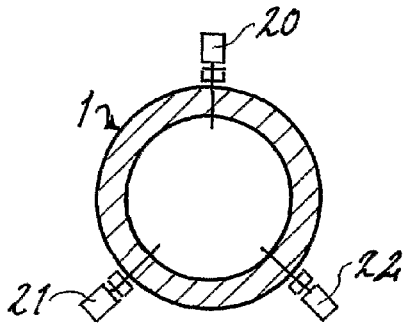
FIG. 3 shows a variant of FIG. 2.

Illustrated in FIG. 3 is a variant in which the perforation takes place simultaneously with three pin dies 20, 21 and 22 arranged at an angle of 120° relative to one another, and these are thus balanced in relation to one another provided that they work simultaneously.

Figure 4:
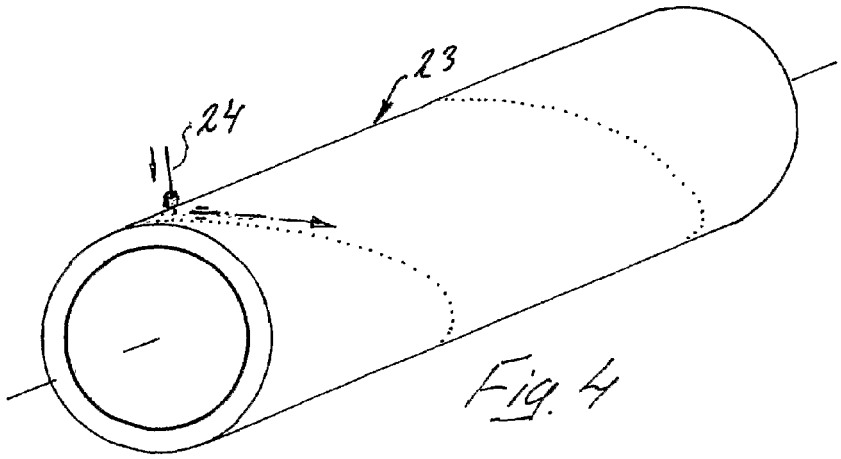
FIG. 4 shows the principles for a spiral perforation of a propellant tube.

FIG. 4, finally, schematically depicts a spiral perforation of a propellant tube 23 by means of a single perforation pin 24 and a combined rotation of the propellant tube and a longitudinal feed of the pin die between each perforation operation.

Illustrated in FIGS. 5*a-e* are a number of principles for the stepped perforation of propellant tubes. FIG. 5 as a whole shows a piece of an imaginary perforated propellant surface where the surface, even if it is actually bulging here, has been drawn flat. The actual propellant surface 25 has a very large number of combustion channels or perforations 26.

FIG. 5*a* shows the basic principle for the perforation, where double arrows 27 and combustion circles 28 show how the propellant from the combustion channels burn towards one another. The purpose of the marking 29 is to draw attention to the equilateral triangular proportion which determines the distance and the lateral displacement between the rows of perforations 26.

FIG. 5*b* illustrates a rectilinear stepped feed of a single perforation pin which accompanies the path from b1 to by, where it has covered the length of the entire propellant tube in order, via a basic relationship determined by one of the equilateral triangular proportions between the perforations, to follow a combined longitudinal and lateral feed to bz marked by the arrow 30, which starts a new row of perforations.

FIG. 5*c* illustrates a zig-zag feed from c1 to c4 and onwards, where every feed involves both a longitudinal feed and a lateral feed, all of which is determined by the equilateral triangle illustrated at 29.

FIG. 5*d* illustrates a concentrating perforation, where a more sparse perforation d1-d3 is concentrated by a second row of perforations dx-dy, etc.

FIG. 5*e*, finally, illustrates the linear feed of a pin die with a number of pins, which jump to their new perforation positions e2 from their perforation positions e1 arranged in a row one after the other.

FIGS. 6*a-c* show a number of different perforation alternatives in a partial section of a propellant tube 31 intended for a 12 cm tank cannon. For the sake of clarity, only a small number of perforations has been drawn in each alternative. The Figures show perforations with an e-dimension distance of 1 mm in principle. It is envisaged that the wall thickness of the propellant tube is 15 mm and, as can be seen from the Figure, the variation in the distance between the perforations at the outer and inner diameters of the tube is quite small here. It is otherwise the case that the perforations 32 in FIG. 6*a* are transcurrent, while the perforations 33 in FIG. 6*b* end at a distance of one e-dimension from the inside 34 of the tube, while the tube in FIG. 6*c* is perforated from both directions with perforations 35 and 36, where the distance between the inner ends of the perforations shall be one e-dimension in this case, too.

Moreover, countless other different systems for perforation are conceivable within the scope of the invention.

The invention claimed is:

1. A method for producing radially perforated, cylindrical propellant tubes which method comprises fixing and centering each propellant tube between its own open ends, and perforating each propellant tube in several stages in a number of consecutive perforation operations by means of one or more movable perforation pins capable of being displaced radially in a pin die relative to each propellant tube through the wall of each propellant tube, which perforation pins are returned after each perforation to their initial positions before perforation, in which position the pin die and the propellant tube are displaced relative to each other so that the pins, on the next occasion on which they are activated, perforate an unprocessed area of a propellant tube, and in conjunction with which the sum of all the perforations after the operation is complete gives an all-over perforation with a desired e-dimension between all the perforations, wherein the e-dimension corresponds to the distance for which a propellant is able to burn from the time of ignition until the time at which the propellant exits from a barrel, with complete combustion during dynamic pressure sequence in a particular artillery piece for which the propellant is intended.

2. Method in accordance with claim 1, which comprises controlling the relative displacement of the pin die and the propellant tube between two perforation stages axially, radially or both of these, in such a way that all the perforations, after the perforation operation has been completed in its entirety, will lie at a distance from one another equivalent to the desired e-dimension for the intended application of the propellant tube.

3. Method in accordance with claim 2, which comprises displacing the pin die, between the perforation stages, in a linear fashion along the entire length of the propellant tube until such time as the whole of that length is covered by perforations, after which rotating the propellant tube about its longitudinal axis through an angle that corresponds to the desired e-dimension, at the same time as which the longitudinal position of the pin die is corrected so that new, unprocessed material faces towards the pin die, and any additional perforations will then lie at an e-dimension distance from the previously executed perforations, after which perforating this previously unprocessed part of the propellant tube in a corresponding fashion followed by further rotating and longitudinally correcting the propellant tube until such time as it has been perforated in its entirety with the desired e-dimension distance.

4. Method in accordance with claim 2, which comprises a feed stage between the perforation operations affecting the propellant tube and the pin die, and distributing the feed stage by a rotation of the propellant tube and a lateral feed of the pin die that are selected in such a way that the perforation of the propellant tube will run in a spiral path around it from its one end to its other end, after which a new spiral path at a distance of one e-dimension from the first begins, until the whole of the propellant tube has been covered by perforations at distance of one e-dimension from one another.

5. Method in accordance with claim 2, which comprises executing mutual relative feed of the pin die and the propellant tube by a controlled rotation of the propellant tube until one revolution has been covered by perforations, after which the pin die is fed for one e-dimension to permit the execution of the next perforation revolution.

6. Method in accordance with claim 2, which comprises using a pin die with several pins arranged in a row after one another at an e-dimension distance from one another in the longitudinal direction of the propellant tube as the pin die, in conjunction with which the longitudinal feed of the pin die in the longitudinal direction of the propellant tube between each perforation stage is equivalent to the number of e-dimensions covered by the pins in the die.

7. Method in accordance with claim 2, which comprises controlling the feed of the pin die and/or the rotation of the propellant tube by gauge blocks, against which fixed abutments come into contact.

8. Method in accordance with claim 1, which comprises displacing the pin die, between the perforation stages, in a linear fashion along the entire length of the propellant tube until such time as the whole of that length is covered by perforations, after which rotating the propellant tube about its longitudinal axis through an angle that corresponds to the desired e-dimension, at the same time as which the longitudinal position of the pin die is corrected so that new, unprocessed material faces towards the pin die, and any additional perforations will then lie at an e-dimension distance from the previously executed perforations, after which perforating an unprocessed part of the propellant tube in a corresponding fashion followed by further rotating and longitudinally correcting the propellant tube until such time as it has been perforated in its entirety with the desired e-dimension distance.

9. Method in accordance with claim 8, which comprises using a pin die with several pins arranged in a row after one another at an e-dimension distance from one another in the longitudinal direction of the propellant tube as the pin die, in conjunction with which the longitudinal feed of the pin die in the longitudinal direction of the propellant tube between each perforation stage is equivalent to the number of e-dimensions covered by the pins in the die.

10. Method in accordance with claim 1, which comprises a feed stage between the perforation operations affecting the propellant tube and the pin die, and distributing the feed stage by a rotation of the propellant tube and a lateral feed of the pin die that are selected in such a way that the perforation of the propellant tube will run in a spiral path around it from its one end to its other end, after which a new spiral path at a distance of one e-dimension from the first begins, until the whole of the propellant tube has been covered by perforations at distance of one e-dimension from one another.

11. Method in accordance with claim 10, which comprises using a pin die with several pins arranged in a row after one another at an e-dimension distance from one another in the longitudinal direction of the propellant tube as the pin die, in conjunction with which the longitudinal feed of the pin die in the longitudinal direction of the propellant tube between each perforation stage is equivalent to the number of e-dimensions covered by the pins in the die.

12. Method in accordance with claim 1, which comprises executing mutual relative feed of the pin die and the propellant tube by a controlled rotation of the propellant tube until one revolution has been covered by perforations, after which the pin die is fed for one e-dimension to permit the execution of the next perforation revolution.

13. Method in accordance with claim 1, which comprises using a pin die with several pins arranged in a row after one another at an e-dimension distance from one another in the longitudinal direction of the propellant tube as the pin die, in conjunction with which the longitudinal feed of the pin die in the longitudinal direction of the propellant tube between each perforation stage is equivalent to the number of e-dimensions covered by the pins in the die.

14. Method in accordance with claim 1, which comprises controlling the feed of the pin die and/or the rotation of the propellant tube by gauge blocks, against which fixed abutments come into contact.

15. Method in accordance with claim 1, which comprises controlling the feed of the pin die and the rotation of the propellant tube by a microcomputer.

* * * * *